US010003155B2

(12) United States Patent
Giefers

(10) Patent No.: US 10,003,155 B2
(45) Date of Patent: Jun. 19, 2018

(54) ELECTRICAL PLUG CONNECTOR PAIR

(71) Applicant: Phoenix Contact GmbH & Co. KG, Blomberg (DE)

(72) Inventor: Stefan Giefers, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days. days.

(21) Appl. No.: 15/519,847

(22) PCT Filed: Oct. 20, 2015

(86) PCT No.: PCT/EP2015/074219
§ 371 (c)(1),
(2) Date: Apr. 18, 2017

(87) PCT Pub. No.: WO2016/062693
PCT Pub. Date: Apr. 28, 2016

(65) Prior Publication Data

US 2017/0244195 A1 Aug. 24, 2017

(30) Foreign Application Priority Data

Oct. 20, 2014 (DE) ..... 10 2014 115 252

(51) Int. Cl.
*H01R 13/627* (2006.01)
*H01R 13/621* (2006.01)

(52) U.S. Cl.
CPC ..... *H01R 13/6275* (2013.01); *H01R 13/621* (2013.01)

(58) Field of Classification Search
CPC ..... H01R 13/6275; H01R 13/621
See application file for complete search history.

(56) References Cited

U.S. PATENT DOCUMENTS 3,207,536 A * 9/1965 Lawrence ..... F16L 37/12 24/630
5,427,538 A * 6/1995 Knapp ..... H01R 13/53 439/157

(Continued)

FOREIGN PATENT DOCUMENTS

DE 3313144 C2 10/1984
DE 102006054647 A1 5/2008

(Continued)

*Primary Examiner* — Alexander Gilman
(74) *Attorney, Agent, or Firm* — Leydig, Voit & Mayer, Ltd.

(57) ABSTRACT

An electrical plug connector pair includes a first plug connector part and a second plug connector part which can be interconnected by a plug connection such that an electrical contact provided in the first plug connector part can be galvanically contacted to an electrical contact provided in the second connector part. The first plug connector part includes a locking element having a locking hook that, in a locking state, can be brought into engagement with a hook receiving portion provided in the second plug connector part such that the locking hook that is brought into engagement with the hook receiving portion in the locking state prevents separation of the two plug connector parts, the locking element being mounted in the first plug connector part so as to be pivotable about a pivot axis such that the locking hook can be released.

14 Claims, 3 Drawing Sheets

(56) References Cited

U.S. PATENT DOCUMENTS

| | | | | |
|---|---|---|---|---|
| 7,435,113 | B2 * | 10/2008 | Cheng | H01R 13/6295 439/157 |
| 7,544,080 | B2 * | 6/2009 | Giefers | H01R 13/6273 439/352 |
| 9,276,345 | B2 * | 3/2016 | Guillanton | H01R 13/4226 |
| 2006/0134953 | A1 * | 6/2006 | Williams | H05K 7/1411 439/157 |
| 2009/0209122 | A1 * | 8/2009 | Heggemann | H01R 9/2625 439/157 |
| 2010/0178787 | A1 * | 7/2010 | Lux | H01R 13/4534 439/271 |

FOREIGN PATENT DOCUMENTS

| | | | |
|---|---|---|---|
| DE | 102010017262 | A1 | 12/2011 |
| DE | 102010032013 | A1 | 1/2012 |
| EP | 2190074 | A1 | 5/2010 |
| WO | WO 2013119530 | A1 | 8/2013 |
| WO | WO 2014131177 | A1 | 9/2014 |

* cited by examiner

ELECTRICAL PLUG CONNECTOR PAIR

CROSS-REFERENCE TO PRIOR APPLICATIONS

This application is a U.S. National Phase application under 35 U.S.C. § 371 of International Application No. PCT/EP2015/074219, filed on Oct. 20, 2015, and claims benefit to German Patent Application No. DE 10 2014 115 252.2, filed on Oct. 20, 2014. The International Application was published in German on Apr. 28, 2016 as WO 2016/062693 A1 under PCT Article 21(2).

FIELD

The invention relates to an electrical plug connector pair comprising a first plug connector part and a second plug connector part which can be interconnected by means of a plug connection such that an electrical contact provided in the first plug connector part can be galvanically contacted to an electrical contact provided in the second plug connector part.

BACKGROUND

In the field of electrical connection technology, electrical plug connector pairs that typically comprise a connector part, such as a connector strip, and a socket part, such as a base strip, are well known from practice. In this respect, DE 10 2006 054 647 A1 describes an electrical plug connector coupling which comprises two connector housings that can be coupled together. The two connector housings can be latched together by means of a latching connection such that unwanted release of the plug connection can be prevented. Another plug connector system is known from DE 10 2010 017 262 A1. In this case, a connecting plug that is placed on a main housing is locked by means of a locking device that can be placed onto the main housing and the connecting plug from above.

Moreover, various ways of attaching plug connector pairs to one another using screws and nuts are known. In this respect, it is known from DE 33 13 144 C2 to screw a plug to a mating part in order to prevent unintended release. A plug connector is further known from EP 2 190 074 A1 that is latched into a socket and in which a latching arm is latched onto a latching tab. In order to prevent an unintended release, a cap is screwed onto the plug and covers the latching lever such that the latching lever is not accessible and thus not operable, and therefore the plug is not releasable, when the cap is screwed on.

These designs known from the prior art are in part only usable with additional outlay against an unintended release of the plug connector pair from one another or cannot easily be decoupled from one another again.

SUMMARY

In an embodiment, the present invention provides an electrical plug connector pair comprising: a first plug connector part; and a second plug connector part configured to be interconnected by a plug connection such that an electrical contact provided in the first plug connector part is galvanically contactable to an electrical contact provided in the second connector part. The first plug connector part comprises a locking element having a locking hook that, in a locking state, is configured to be brought into engagement with a hook receiving portion provided in the second plug connector part such that the locking hook that is brought into engagement with the hook receiving portion in the locking state prevents separation of the two plug connector parts. The locking element is mounted in the first plug connector part so as to be pivotable about a pivot axis such that the locking hook is releasable from the hook receiving portion by pivoting the locking element, a locking bolt being arranged in a guide provided in the locking element so as to be longitudinally displaceable in the guide, such that the locking bolt is insertable into a bolt receiving portion and/or is removable therefrom by longitudinal displacement. The bolt receiving portion is arranged in a different region of the first plug connector part from the locking element such that a pivot movement of the locking element is blocked when the locking bolt is inserted into the bolt receiving portion.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
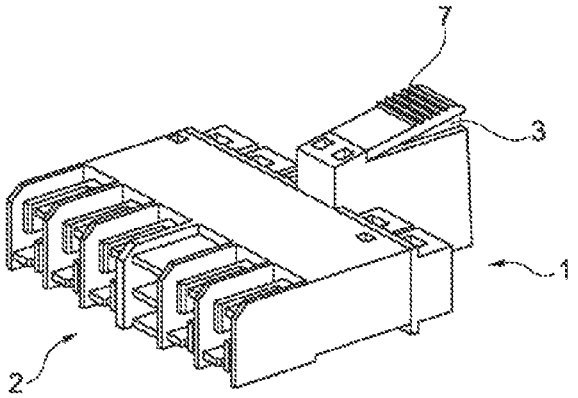
FIG. 1 is a perspective view of an electrical plug connector pair comprising a first plug connector part according to a preferred embodiment of the invention in the plugged-in state.

The invention therefore in an embodiment provides an electrical plug connector pair comprising a first plug connector part and a second connector part which can be interconnected by means of a plug connection such that an electrical contact provided in the first plug connector part can be galvanically contacted to an electrical contact provided in the second connector part, characterized in that the first plug connector part comprises a locking element having a locking hook that, in a locking state, can be brought into engagement with a hook receiving portion provided in the second plug connector part, such that the locking hook that is brought into engagement with the hook receiving portion in the locking state prevents separation of the two plug connector parts, the locking element is mounted in the first plug connector part so as to be pivotable about a pivot axis, such that the locking hook can be released from the hook receiving portion by pivoting the locking element, a locking bolt is arranged in a guide provided in the locking element so as to be longitudinally displaceable in said guide, such that the locking bolt can be inserted into a bolt receiving portion of this type and/or can be removed therefrom by means of a longitudinal displacement, said bolt receiving portion being arranged in a different region of the first plug connector part from the locking element, such that a pivot movement of the locking element is blocked when the locking bolt is inserted into the bolt receiving portion.

In a preferred embodiment, both a locking bolt and a bolt receiving portion are provided in a plug connector part of the electrical plug connector pair according to the invention, into which bolt receiving portion the locking bolt can be inserted and/or from which bolt receiving portion the locking bolt can be removed. By arranging the locking bolt in a locking element that is pivotally mounted inside the plug connector part, pivoting of the locking element can be blocked when the locking bolt is inserted into the bolt receiving portion. A locking hook attached to the locking element can therefore no longer be removed from a hook receiving portion provided in the other plug connector part either, such that secure locking of the two plug connector parts to one another is ensured. Only when the locking bolt is removed from the bolt receiving portion again can the locking element be pivoted again, allowing for the locking hook to thus be removed from the hook receiving portion.

The locking element can be pivoted in a different way in order to unlock the two plug connector parts of the plug connector pair from one another. However, according to a preferred development of the invention, it is provided for the locking element to comprise a manually operable actuation region, application of force to which region causing the locking element to pivot in such a way that the locking hook is released from the hook receiving portion, preferably specifically pivoted out of the hook receiving portion. Such an actuation region of the locking element is therefore preferably arranged in such a way that it can be pressed from the outside by hand or using a tool such that the desired pivoting of the locking element is achieved as a result of the associated force application so that the locking hook is released from the hook receiving portion.

In principle, the locking bolt can be designed as a simple pin that is mounted in the guide so as to have axial play and can thus be pushed into the bolt receiving portion in order to lock the two plug connector parts together. In this respect, the bolt receiving portion can be designed as a simple hole, e.g. in the housing of the first plug connector part. However, according to a preferred development of the invention, the locking bolt is a threaded screw and the bolt receiving portion has an internal thread corresponding to the threaded screw, i.e. is preferably designed as a threaded nut, such that the threaded screw can be screwed into the internal thread of the bolt receiving portion. This preferred embodiment of the invention is particularly advantageous in so far as the fact that the locking bolt, designed as a threaded screw, is screwed into the internal thread of the bolt receiving portion, designed as a threaded nut, means that there is no risk of an unwanted release of the locking bolt from the bolt receiving portion even in the event of mechanical loading, such as when vibrations act on the electrical plug connector pair. Preferably, the threaded screw is captivated in the guide, but so as to have axial play.

According to a preferred development of the invention, it is further provided for the locking element to comprise a spring tongue, by means of which the locking element rests on a support provided inside the first plug connector part in such a way that the locking hook is forced into the hook receiving portion when the two plug connector parts are in the plugged-in state. In other words, this means that the spring tongue is designed and attached to the locking element in such a way that, whenever the locking hook is pivoted out of the region of the hook receiving portion, a restoring force is brought about on the locking element such that the locking hook is accordingly pivoted back. This ensures that the locking hook always retains its equilibrium position inside the hook receiving portion in the plugged-in state without external influence on the locking element in the locking state.

The possibility of the locking element being pivotable inside the first plug connector part can be realized in various manners. Preferably, however, a peg is arranged inside the first plug connector part, and the locking element comprises a peg receiving portion, by means of which it rests on the peg such that the locking element is pivotable about the peg. In this preferred embodiment of the invention, the pivot axis thus extends inside the peg, about which the locking element is pivotable. As a result, additional movable parts are not needed. This makes it particularly easy to produce the first plug connector part, in particular as an injection-molded part.

Furthermore, according to a preferred development of the invention, it is provided for the locking hook to have a starting bevel which comes into contact with a corresponding surface of the second plug connector part when the two plug connector parts are plugged together, such that the locking hook is deflected in a direction perpendicular to the plug-in direction. Similarly to the case of a conventional lock, when the two plug connector parts are plugged together the locking hook can therefore retreat, i.e. can be deflected perpendicularly to the plug-in direction, on account of the starting bevel, in order to then snap back in behind the corresponding surface of the second plug connector part and engage in the hook receiving portion. It is therefore not necessary to actively pivot the locking hook in order to bring it into engagement with the hook receiving portion.

There are various options for fitting the locking hook to the locking element. According to an embodiment of the invention, the locking hook is rigidly connected to the locking element such that a deflection of the locking hook perpendicularly to the plug-in direction causes the locking element to pivot. However, in so far as this pivoting of the locking element is blocked, e.g. because the locking bolt is inserted into the bolt receiving portion, the locking hook cannot be deflected and therefore the two plug connector parts cannot lock together either. In this respect, according to a preferred development of the invention, it is provided for the locking hook to be resiliently connected to the locking element such that a deflection of the locking hook perpendicularly to the plug-in direction is also possible without the locking element being pivoted.

This allows the two plug connector parts to also lock together when the locking bolt is already inserted into the bolt receiving portion, and therefore pivoting of the locking element is no longer possible. However, locking does not require the locking element to be pivoted in this manner when, according to a preferred development of the invention, the locking hook is resiliently connected to the locking element and the locking hook can therefore be pivoted perpendicularly to the plug-in direction during the plug-in process on account of this resilience, in order to then automatically snap back and engage in the hook receiving portion. This makes it possible, for example, to pre-assemble the first plug connector part in such a way that the locking bolt is already inserted into the bolt receiving portion so that it is not possible to forget to secure the locking bolt in order to lock the two plug connector parts after said parts have been plugged in.

Figure 2:
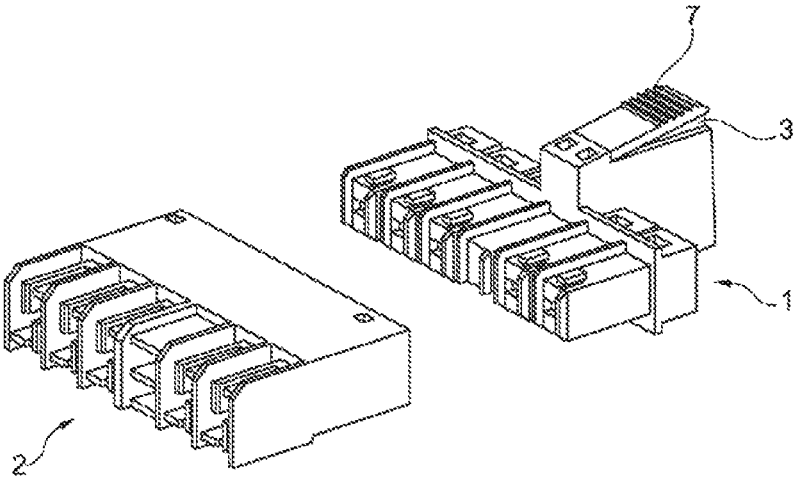
FIG. 2 is a perspective view of the electrical plug connector pair according to the preferred embodiment of the invention in the unplugged state.

FIGS. 1 and 2 show, in the plugged-in state and in the unplugged state, respectively, an electrical plug connector pair according to a preferred embodiment of the invention, comprising a first plug connector part 1 and a second plug connector part 2. In the present case, the first plug connector part 1 is a connector strip that can be plugged into the second plug connector part 2, which is designed as a base strip. In this way, the electrical contacts provided in the first plug connector part 1 can be brought into galvanically conductive contact with corresponding electrical contacts provided in the second plug connector part.

In order to prevent unwanted release of the first plug connector part 1 from the second plug connector part 2 in the plugged-in state of the plug connector pair, the first plug connector part 1 comprises a locking element 3, a manually operable actuation region 7 of which can substantially be seen in FIGS. 1 and 2. A force can be applied to this actuation region 7 by means of a finger of a user or a tool in order to unlock the two plug connector parts from one another, as is set out in detail below.

Figure 3:
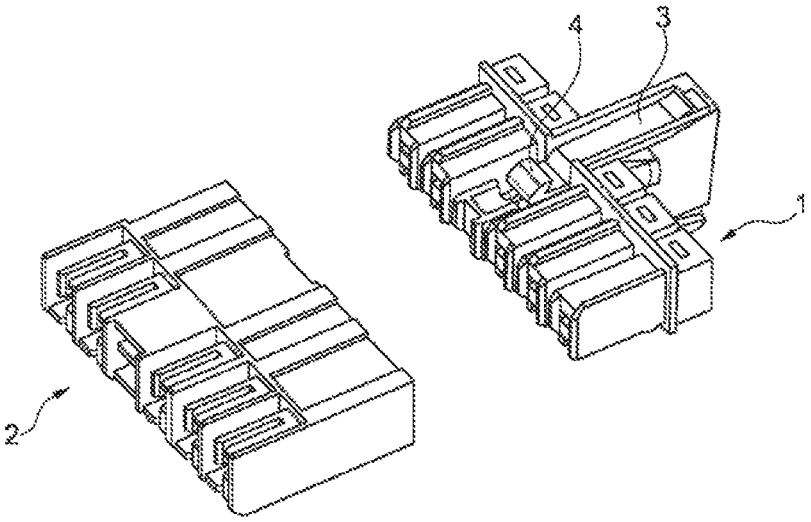
FIG. 3 is a perspective view of the electrical plug connector pair according to the preferred embodiment of the invention in the unplugged state, the top having been removed.

For this purpose, as can be seen in FIG. 3, which shows the two plug connector parts 1, 2 with their tops removed, the locking element 3 is provided with a locking hook 4. The functionality of the locking hook and the interaction thereof with the second plug connector part 2 is explained below with reference to FIGS. 4, 5 and 6, which are each cross sections of the electrical connector pair in the plugged-in state.

Figure 4:
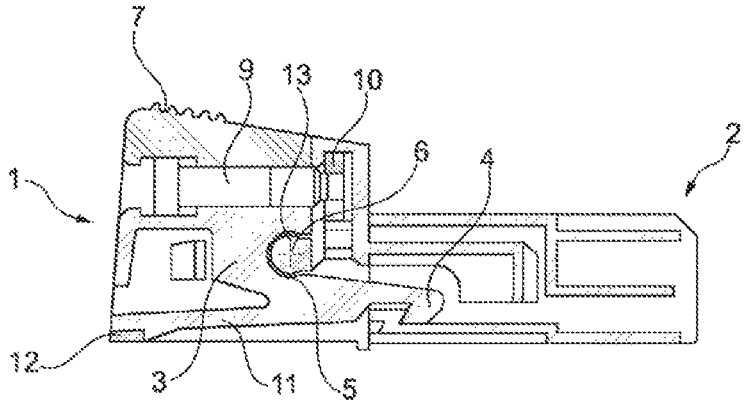
FIG. 4 is a sectional view of the electrical plug connector pair according to the preferred embodiment of the invention in the locking state.

FIG. 4 shows the electrical plug connector pair according to the preferred embodiment of the invention, in which the first plug connector part 1 is plugged into the second plug connector part 2. The locking hook 4 of the locking element 3 ensures that the first plug connector part 1 is locked to the second connector part 2, said locking hook being engaged in a hook receiving portion 5 provided in the second locking part 2. Because the locking hook is engaged in the hook receiving portion 5, separation of the first plug connector part 1 from the second plug connector part 2 is prevented.

The locking element 3 is mounted in the plug connector part 1 so as to be pivotable about a pivot axis 6. For this purpose, the locking element 3 comprises a peg receiving portion 14 in which a peg 13 arranged on the housing of the first plug connector part 1 engages. In this way, the locking element 3 as a whole can be pivoted about the pivot axis 6 defined by the peg 13.

Figure 5:
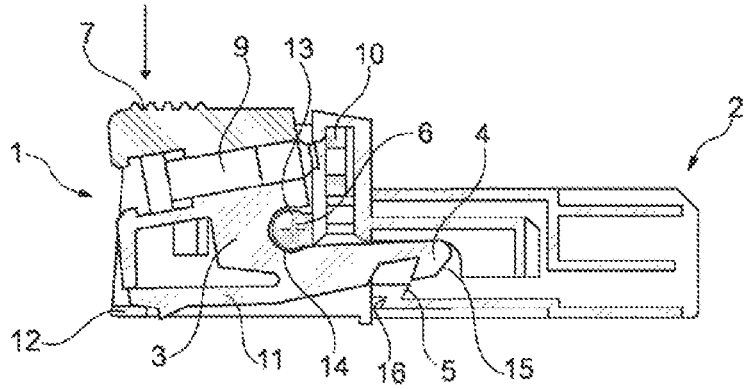
FIG. 5 is a sectional view of the electrical plug connector pair according to the preferred embodiment of the invention during unlocking of the locking hook.

As can be seen in FIG. 5, which shows the locking hook 4 being unlocked from the hook receiving portion 5, the locking hook 4 can be pivoted out of the hook receiving portion 5 by applying a force to the actuation region 7 of the locking element 3, indicated by a downwardly pointing arrow. The locking element 3 as a whole is pre-stressed by means of a spring tongue 11, which is attached to the locking element 3 and rests on a support 13 arranged in the first plug connector part 1, such that said locking element counteracts an application of force to the actuation region 7 of the locking element 3, and the locking hook 4 engages in the hook receiving portion 5 in the state of equilibrium when the plug connector pair is plugged in.

As can be seen in both FIGS. 4 and 5, a locking bolt 9, which is designed as a threaded screw and is guided in a guide 8 so as to have axial play but so as to be captivated, is not inserted into a bolt receiving portion 10 arranged on the housing of the first plug connector part 1. This allows the locking element 3 to be freely pivotable by means of applying a force to the actuation region 7, and therefore it is possible for the locking element 3 to pivot, as shown in FIG. 5, and thus also for the locking hook 4 to pivot out of the hook receiving portion 5.

Figure 6:
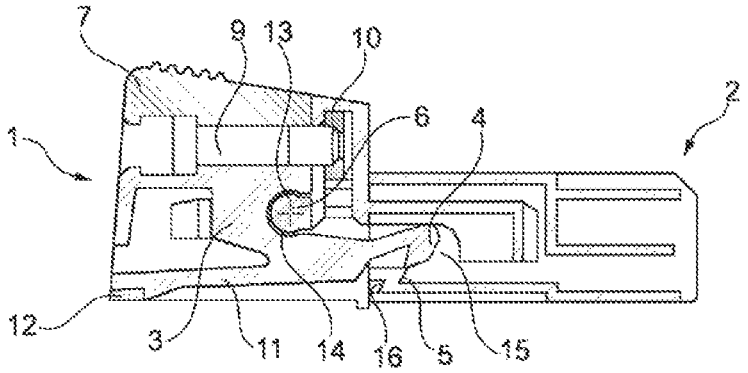
FIG. 6 is a sectional view of the electrical plug connector pair according to the preferred embodiment of the invention during locking and when the locking bolt received in the bolt receiving portion.

FIG. 6 shows that the locking bolt 9, designed as a threaded screw, is screwed into the bolt receiving portion 10, designed as a threaded nut. This prevents pivoting of the locking element 3. Specifically, the locking element 3 can no longer be moved by means of applying a force to the actuation region 7. Nevertheless, according to the preferred embodiment of the invention described here, the first plug connector part 1 can be plugged into and locked to the second plug connector part 2 when the locking bolt 9 is screwed into the bolt receiving portion 10. Specifically, the locking hook 4 is resiliently connected to the locking element 3 such that the locking hook 4 can be pivoted perpendicularly to the plug-in direction without it being necessary to simultaneously pivot the locking element 3. This means that, when plugging the first plug connector part 1 into the second plug connector part 2 when the locking bolt 9 is fixed in the bolt receiving portion 10, the locking hook can yield perpendicularly to the plug-in direction when it comes into contact with a corresponding surface of the second plug connector part 2. This is made easier, in particular, by the locking hook 4 being provided with a starting bevel 15 that supports a movement of the locking hook 4 perpendicularly to the plug-in direction when the starting bevel 15 strikes a corresponding surface 16 of the second plug connector part 2.

This means that the first plug connector part 1 can also form a locking plug connection with the second plug connector part 2 when the locking bolt 9 is already fixed in the bolt receiving portion 10. The first plug connector part 1 can therefore be accordingly pre-assembled, with the locking bolt 9 locked in the bolt receiving portion 10, such that a user can no longer forget to lock the first plug connector part 1 to the second plug connector part 2 in the plugged-in state of the plug connector pair.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 first plug connector part
2 second plug connector part
3 locking element
4 locking hook
5 hook receiving portion
6 pivot axis
7 actuation region
8 guide
9 locking bolt
10 bolt receiving portion
11 spring tongue
12 support
13 peg
14 peg receiving portion
15 starting bevel
16 corresponding surface

The invention claimed is:

1. An electrical plug connector pair comprising:

a first plug connector part; and a second plug connector part configured to be interconnected by a plug connection such that an electrical contact provided in the first plug connector part is galvanically contactable to an electrical contact provided in the second connector part, wherein the first plug connector part comprises a locking element having a locking hook that, in a locking state, is configured to be brought into engagement with a hook receiving portion provided in the second plug connector part such that the locking hook that is brought into engagement with the hook receiving portion in the locking state prevents separation of the two plug connector parts, the locking element being mounted in the first plug connector part so as to be pivotable about a pivot axis such that the locking hook is releasable from the hook receiving portion by pivoting the locking element, a locking bolt being arranged in a guide provided in the locking element so as to be longitudinally displaceable in the guide, such that the locking bolt is insertable into a bolt receiving portion and/or is removable therefrom by longitudinal displacement, the bolt receiving portion being arranged in a different region of the first plug connector part from the locking element such that a pivot movement of the locking element is blocked when the locking bolt is inserted into the bolt receiving portion, and wherein the locking element comprises a spring tongue, by which the locking element rests on a support provided inside the first plug connector part in such a way that the locking hook is configured to be forced into the hook receiving portion when the two plug connector parts are in a plugged-in state.

2. The electrical plug connector pair according to claim 1, wherein the locking element comprises a manually operable actuation region, and application of force to which region causes the locking element to pivot in such a way that the locking hook is released from the hook receiving portion.

3. The electrical plug connector pair according to claim 1, wherein the locking holt comprises a threaded screw and the bolt receiving portion has an internal thread corresponding to the threaded screw, such that the threaded screw is configured to be screwed into the internal thread of the holt receiving portion.

4. The electrical plug connector pair according to claim 3, wherein the threaded screw is captivated in the guide, but so as to have axial play.

5. The electrical plug connector pair according to claim 1, wherein a peg is arranged inside the first plug connector part and the locking element comprises a peg receiving portion, by which it rests on the peg such that the locking element is pivotable about the peg.

6. The electrical plug connector pair according to claim 1, wherein the locking hook has a starting bevel which is configured to come into contact with a corresponding surface of the second plug connector part when the two plug connector parts are plugged together, such that the locking hook is deflected in a direction that is perpendicular to the plug-in direction.

7. The electrical plug connector pair according to claim 1, wherein the locking hook is rigidly connected to the locking element such that a deflection of the locking hook perpendicular to the plug-in direction causes the locking element to pivot.

8. The electrical plug connector pair according to claim 1, wherein the locking hook is resiliently connected to the locking element such that the locking hook may deflect perpendicularly to the plug-in direction without the locking element being pivoted.

9. The electrical plug connector pair according to claim 2, wherein the locking hook is pivoted out of the hook receiving portion.

10. The electrical plug connector pair according to claim 3, wherein the bolt receiving portion comprises a threaded nut.

11. The electrical plug connector pair according to claim 10, wherein the threaded screw is captivated in the guide with axial play.

12. An electrical plug connector pair comprising:

a first plug connector part; and a second plug connector part configured to be interconnected by a plug connection such that an electrical contact provided in the first plug connector part is galvanically contactable to an electrical contact provided in the second connector part, wherein the first plug connector part comprises a locking element having a locking hook that, in a locking state, is configured to be brought into engagement with a hook receiving portion provided in the second plug connector part such that the locking hook that is brought into engagement with the hook receiving portion in the locking state prevents separation of the two plug connector parts, the locking element being mounted in the first plug connector part so as to be pivotable about a pivot axis such that the locking hook is releasable from the hook receiving portion by pivoting the locking element, a locking bolt being arranged in a guide provided in the locking element so as to be longitudinally displaceable in the guide, such that the locking bolt is insertable into a bolt receiving portion and/or is removable therefrom by longitudinal displacement, the bolt receiving portion being arranged in a different region of the first plug connector part from the locking element such that a pivot movement of the locking element is blocked when the locking bolt is inserted into the bolt receiving portion, and wherein the locking hook has a starting bevel which is configured to come into contact with a corresponding surface of the second plug connector part when the two plug connector parts are plugged together, such that the locking hook is deflected in a direction that is perpendicular to the plug-in direction.

13. An electrical plug connector pair comprising:

a first plug connector part; and a second plug connector part configured to be interconnected by a plug connection such that an electrical contact provided in the first plug connector part is galvanically contactable to an electrical contact provided in the second connector part, wherein the first plug connector part comprises a locking element having a locking hook that, in a locking state, is configured to be brought into engagement with a hook receiving portion provided in the second plug connector part such that the locking hook that is brought into engagement with the hook receiving portion in the locking state prevents separation of the two plug connector parts, the locking element being mounted in the first plug connector part so as to be pivotable about a pivot axis such that the locking hook is releasable from the hook receiving portion by pivoting the locking element, a locking bolt being arranged in a guide provided in the locking element so as to be longitudinally displaceable in the guide, such that the locking bolt is insertable into a bolt receiving portion and/or is removable therefrom by longitudinal displacement, the bolt receiving portion being arranged in a different region of the first plug connector part from the locking element such that a pivot movement of the locking element is blocked when the locking bolt is inserted into the bolt receiving portion; and wherein the locking hook is rigidly connected to the locking element such that a deflection of the locking hook perpendicular to the plug-in direction causes the locking element to pivot.

14. An electrical plug connector pair comprising:

a first plug connector part; and a second plug connector part configured to be interconnected by a plug connection such that an electrical contact provided in the first plug connector part is galvanically contactable to an electrical contact provided in the second connector part, wherein the first plug connector part comprises a locking element having a locking hook that, in a locking state, is configured to be brought into engagement with a hook receiving portion provided in the second plug connector part such that the locking hook that is brought into engagement with the hook receiving portion in the locking state prevents separation of the two plug connector parts, the locking element being mounted in the first plug connector part so as to be pivotable about a pivot axis such that the locking hook is releasable from the hook receiving portion by pivoting the locking element, a locking bolt being arranged in a guide provided in the locking element so as to be longitudinally displaceable in the guide, such that the locking bolt is insertable into a bolt receiving portion and/or is removable therefrom by longitudinal displacement, the bolt receiving portion being arranged in a different region of the first plug connector part from the locking element such that a pivot movement of the locking element is blocked when the locking bolt is inserted into the bolt receiving portion, and wherein the locking hook is resiliently connected to the locking element such that the locking hook may deflect perpendicularly to the plug-in direction without the locking element being pivoted.

* * * * *